US008100987B2

(12) United States Patent
Middleton

(10) Patent No.: US 8,100,987 B2
(45) Date of Patent: Jan. 24, 2012

(54) CLEANING FLUID AND METHODS

(75) Inventor: Richard G. Middleton, Columbia, SC (US)

(73) Assignee: Jane D. Middleton, Thomasville, GA (US)

( * ) Notice: Subject to any disclaimer, the term of this patent is extended or adjusted under 35 U.S.C. 154(b) by 1268 days.

(21) Appl. No.: 11/521,502

(22) Filed: Sep. 15, 2006

(65) Prior Publication Data

US 2007/0028396 A1 Feb. 8, 2007

Related U.S. Application Data

(63) Continuation-in-part of application No. PCT/US2005/008454, filed on Mar. 15, 2005, and a continuation-in-part of application No. 10/802,060, filed on Mar. 16, 2004, now abandoned.

(51) Int. Cl.
*D06L 1/02* (2006.01)

(52) U.S. Cl. ..... 8/137; 134/6; 134/8; 134/40; 510/285; 510/286

(58) Field of Classification Search ..... None
See application file for complete search history.

(56) References Cited

U.S. PATENT DOCUMENTS

| | | | | |
|---|---|---|---|---|
| 2,925,367 | A | 2/1960 | Soelberg | 202/176 |
| 3,120,567 | A | 2/1964 | Dial | 260/652.5 |
| 3,274,755 | A | 9/1966 | Montagnon et al. | 55/171 |
| 3,285,858 | A | 11/1966 | Hirsch et al. | 252/171 |
| 3,302,300 | A | 2/1967 | McClead | 34/75 |
| 3,337,471 | A | 8/1967 | Levy et al. | 252/153 |
| 3,451,234 | A | 6/1969 | Palmer | 68/18 |
| 3,649,166 | A | 3/1972 | Wolf et al. | 514/562 |
| 4,483,160 | A | 11/1984 | Jost | 68/18 |
| 4,694,588 | A | 9/1987 | Bagolin et al. | 34/77 |
| 4,817,296 | A | 4/1989 | Kabakov et al. | 34/77 |
| 4,984,318 | A | 1/1991 | Coindreau-Palau | |
| 5,107,605 | A | 4/1992 | Yamada et al. | 34/74 |
| 5,152,845 | A | 10/1992 | Li | 134/40 |
| 5,213,594 | A | 5/1993 | Cannon et al. | 55/97 |
| 5,467,539 | A | 11/1995 | Hahn | 34/77 |
| 5,538,646 | A | 7/1996 | Middleton | 210/671 |
| 5,586,456 | A | 12/1996 | Takagawa et al. | 68/18 |

(Continued)

FOREIGN PATENT DOCUMENTS

EP 1 300 501 A1 9/2003

(Continued)

OTHER PUBLICATIONS

Campbell, Todd; *Hung Out to Dry. How the Use of Perchloroethylene in Dry Cleaning Endangers You and Your Family's Health;* A Coalition for Clean Air Report; (Oct. 2002).

(Continued)

*Primary Examiner* — Necholus Ogden, Jr.
(74) *Attorney, Agent, or Firm* — Haynes and Boone, LLP

(57) ABSTRACT

Cleaning fluids that include n-propyl bromide and an additive that includes a non-hazardous stabilizer component, a pH-balancing agent, an odor-controlling agent, or a combination thereof. Also included are a method for cleaning textile absorbers and removing extraneous substances therefrom using this and related cleaning fluids, such as by cleaning textile absorbers in a cleaning fluid that includes n-propyl bromide to remove a portion of the extraneous substances from the textile absorber, preferably wherein the cleaning fluid is substantially free of hazardous materials.

20 Claims, 3 Drawing Sheets

U.S. PATENT DOCUMENTS

| | | | | |
|---|---|---|---|---|
| 5,665,170 | A | 9/1997 | Lee et al. | 134/19 |
| 5,792,277 | A | 8/1998 | Shubkin et al. | 134/19 |
| 5,887,454 | A | 3/1999 | Renzacci | 68/18 |
| 5,916,336 | A | 6/1999 | Middleton | 8/159 |
| 5,990,071 | A | 11/1999 | Shubkin | 510/412 |
| 6,009,585 | A | 1/2000 | Middleton | 8/158 |
| 6,230,353 | B1 | 5/2001 | Middleton | 8/159 |
| 6,350,395 | B1 | 2/2002 | Kuemin | 252/401 |
| 6,402,857 | B2 | 6/2002 | Clark et al. | 134/31 |
| 6,536,061 | B1 | 3/2003 | Middleton | 8/159 |
| 6,558,432 | B2 | 5/2003 | Schulte et al. | 8/142 |
| 6,660,701 | B1 | 12/2003 | Degroot | 510/177 |
| 6,689,734 | B2 | 2/2004 | Doyel et al. | 510/410 |
| 6,699,829 | B2 | 3/2004 | Doyel et al. | 510/410 |
| 6,743,300 | B2 | 6/2004 | Gray | 134/12 |
| 6,755,871 | B2 | 6/2004 | Damaso et al. | 8/137 |
| 6,783,602 | B2 | 8/2004 | Gray | 134/10 |
| 6,929,702 | B1 | 8/2005 | Motsenbocker | 134/6 |
| 2002/0010965 | A1 | 1/2002 | Schulte et al. | 8/142 |
| 2002/0011258 | A1 | 1/2002 | Damaso et al. | 134/26 |
| 2003/0061844 | A1 | 4/2003 | Carnovale | 68/18 R |
| 2003/0083220 | A1 | 5/2003 | Doyel et al. | 510/412 |
| 2003/0220219 | A1 | 11/2003 | Schulte et al. | 510/407 |
| 2003/0228997 | A1 | 12/2003 | Doyel et al. | 510/410 |
| 2004/0087465 | A1 | 5/2004 | DeGroot et al. | 510/412 |
| 2004/0173246 | A1 | 9/2004 | Damaso et al. | 134/26 |
| 2004/0224870 | A1 | 11/2004 | Doyel et al. | 17/0 |
| 2005/0204478 | A1 | 9/2005 | Middleton | 8/137 |

FOREIGN PATENT DOCUMENTS

| | | | |
|---|---|---|---|
| EP | 1300501 | * | 9/2003 |
| EP | 0994929 | B1 | 9/2004 |
| GB | 954831 | | 4/1964 |
| GB | 2338960 | | 1/2000 |
| JP | 07150197 | | 6/1995 |
| JP | 09302389 | | 11/1997 |
| JP | 11-246898 | | 9/1999 |
| JP | 02241796 | | 8/2002 |
| JP | 03144796 | | 5/2003 |
| JP | 04018789 | | 1/2004 |
| WO | WO 96/05351 | | 2/1996 |
| WO | WO 98/50517 | | 11/1998 |
| WO | WO99/02615 | | 1/1999 |
| WO | WO 01/53598 | | 7/2001 |
| WO | WO 2005/089277 | A2 | 9/2005 |

OTHER PUBLICATIONS

European Chlorinated Solvent Association; *n-Propyl Bromide and Solvent Use;* Solvent Digest; No. 22, p. 2; (Nov. 2002).

Albermarle Corporation; *MSDS—ABZOL® VG Cleaner*; (Jun. 2002).

MDL Information Systems, Inc.; *MSDS—Ensolve™ Precision Vapor Degreasing and Cleaning Solvent;* (2006).

Redox Chemicals Pty. Ltd.; *MSDS—Ensolve Solvent;* (Jun. 1998).

Tech Spray, Inc.; *MSDS—Solvon PB Degreaser;* (Sep. 2001).

Poly Systems USA, Inc.; *MSDS—Solvon® AER;* (Apr. 2001).

Poly Systems USA, Inc.; *MSDS—Solvon® DR;* (Jun. 2001).

Poly Systems USA, Inc.; *MSDS—Solvon® PBA;* (Jun. 1999).

MDL Information Systems, Inc.; *MSDS—Vaporedge 1000;* (2006).

Examination Report, Australian Patent Application No. 2005222955, mailed Dec. 21, 2009.

* cited by examiner

CLEANING FLUID AND METHODS

CROSS REFERENCE TO RELATED APPLICATIONS

This application is a continuation-in-part of International Application No. PCT/US2005/008454, filed on Mar. 15, 2005, and a continuation-in-part of U.S. application Ser. No. 10/802,060, filed Mar. 16, 2004, now abandoned, the disclosure of each of which is incorporated herein by express reference thereto in its entirety for all purposes.

FIELD OF THE INVENTION

The present invention is directed to a cleaning fluid, a method, and an apparatus for cleaning fabrics, and in particular, cleaning fabrics with n-propyl bromide-based cleaning fluids to remove extraneous substances therefrom.

BACKGROUND OF THE INVENTION

The desorption or removal of extraneous substances from fabrics is a prevalent industrial process. As used herein, the term "extraneous substance" refers to any substance that becomes attached to or is absorbed by a fabric during the use of the fabric. Extraneous substances can include dirt, industrial lubricants such as oils, grease, coolants, water, glycol, and solvents, as well as particulates. In the dry cleaning industry, extraneous substances can include body oils and liquids, as well as soil stains. As a result, the current art contains a variety of different methods by which these substances are either removed from a fabric so that the fabric can be reused.

The steps that are used to separate extraneous substances from fabrics so that the fabrics can be cleaned or recycled for reuse must be chosen so that the desired results: maximum cleaning and minimum waste generation are achieved. Optimization of cleaning inevitably results in a process that is specific to a particular waste stream; that is, the steps of that process will be dictated by the fabric and the composition of absorbed extraneous substance.

The minimization of waste generation, on the other hand, is dictated by those steps that will result in the cleanest materials. Further, the goal of cleanest fabrics is often associated with the generation of harmful wastes to the environment.

In response to the need for a cleaning process that is simple, effective, and allows the cleaning and recycling of fabrics for reuse, the present inventor developed a process described in U.S. Pat. Nos. 6,230,353 and 6,536,061. Although this process met existing needs, it did not address the growing concern regarding typical dry cleaning fluids, such as perchloroethylene. Because various local, state, and federal agencies consider these dry cleaning fluids to be hazardous wastes, the use of them in a cleaning step necessitates their treatment and/or disposal. Not only is hazardous waste disposal costly, but it imposes significant requirements for careful handling in order to protect the environment. Perchloroethylene is also considered to be a health hazard to those that may become over exposed to its fumes if not properly handled and ventilated.

Furthermore, common dry cleaning fluids oftentimes require the use of single to multiple industrial distillers to accommodate their high distillation points. These types of distillers consume significant energy resources and require careful monitoring.

Although cleaning methods thought to be environmentally friendly alternatives to dry cleaning exist, these methods bring with them additional complications and disadvantages. For example, the use of wet cleaning implicates the environmental regulation of water. Another cleaning method uses liquid carbon dioxide as an alternative to perchloroethylene. However, this method requires the use of specially designed machines capable of handling the high pressure required to sustain liquid carbon dioxide.

Therefore, there remains a need for a method and apparatus for removing extraneous substances from fabrics that is simple, safe, effective, environmentally sound, and energy conserving.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, an embodiment of the present invention includes a method and system for removing extraneous substances from fabrics so that the fabrics can be cleaned or recycled for reuse. In the case of the fabrics, recycle means that the fabrics are ready for reuse following application of the present process. Because some of the extraneous substances removed, such as oil, are also capable of being recovered and recycled, in the case of these substances, recycle may require further steps.

The present invention has industrial applicability, because it enables the cleaning of various materials used for industrial processes so that these materials can be reused. For example, such materials as shop cloths and oil-absorbers can be effectively cleaned for reuse without the need to employ environmentally harmful cleaning agents. However, this invention is in no way limited to this industrial applicability. For example, the present invention may also be applied to the cleaning of clothes. The present process can be an alternative to common dry cleaning methods.

The main component of the system is a cleaning component. Fabrics bearing extraneous substances are cleaned through the use of a particular cleaning fluid. The specific cleaning steps are not critical to the process as long as the cleaning fluid used is n-propyl bromide. Additionally, the system can include an excess extraneous substance removal component that precedes the cleaning component so that less energy is spent cleaning the fabrics in the cleaning component. For the cleaning of clothing or normal garment cleaning this additional step is not usually required.

If the system includes the optional excess substance removal component, excess extraneous substances, such as oil and metal chips, can be removed from the-fabrics by gravity draining by mechanical squeezing, by centrifuging, or by the combination of these. For example, these extraneous substances can be drained by-placing oil-absorbing materials into drums and allowing the substances to drain from the fabrics to the bottoms of the drums. Alternatively, the extraneous substances can be drained by gravity into a sump. Additionally, extraneous substances can be removed by manually wringing or squeezing the fabrics. The removed extraneous substances can then be pumped to a settling tank where they can be removed or recovered by various recovery techniques known in the art.

In the cleaning component of the present system, the fabrics are cleaned by a cleaning technique, which employs the cleaning fluid n-propyl bromide. Although the cleaning technique is not critical, a preferred technique is dry cleaning. For example, the fabrics can be dry cleaned using an industrial dry cleaning machine. Additionally, the dry cleaning machine can be a closed loop machine that is connected to a distiller, a dry cleaning fluid tank for storing the dry cleaning fluid, and a waste container. The fluid tank for storing the dry cleaning fluid is preferably closed and is preferably maintained at ambient temperature to minimize or avoid the need for refrigeration or heating equipment associated therewith. Through the use of a closed loop dry cleaning machine, the cleaning fluid may be distilled and reused for multiple cycles. However, it is also contemplated by the present invention that various cleaning apparatuses and methods can be used other than dry cleaning machines. If a closed loop dry cleaning machine is used, the effluent from dry cleaning the fabrics is distilled to remove as much extraneous substance from the cleaning fluid as possible and to assure that the dry cleaning fluid, when reused to dry clean the fabrics, is as clean as possible. Although the use of one distiller is sufficient for the process of the present invention, it is also contemplated that two distillers be used so that the cleaning fluid is distilled twice not only to ensure that the cleaning fluid is as clean as possible when it is reused, but to ensure there is always sufficient cleaning fluid available for reuse in new cleaning batches. Preferably, when two distillers are included, these are arranged in sequence or as a two-stage distillation process. The extraneous substance collected in the distiller apparatus is thereafter removed and handled appropriately depending on the type of extraneous substance.

In another embodiment, the present invention can include an apparatus for cleaning materials using the cleaning fluid n-propyl bromide. The apparatus can include a main rotating drum for receiving materials needing to be cleaned, as well as cleaning fluid. The cleaning fluid is provided by a main holding tank that is in fluid communication with the drum. Below the drum can be included a multi-level filter for separating any suspended particles from the cleaning fluid and resulting effluent from the dry cleaning cycle. The filter is housed within a container that collects the used cleaning fluid. The container is in fluid communication with a dry cleaning fluid reclamation system that includes a distiller connected to a water separator. The water separator is in fluid communication with the main holding tank, so that the reclaimed cleaning fluid can be reused for additional dry cleaning cycles. Optionally, a conduit joining the multi-filter container and the distiller can include a lint and dye removal filter. Additionally, the drum can include a vapor filtering system, which facilitates drying of the cleaned materials.

A feature of the present invention is the use of a particular cleaning fluid that is an environmentally sound improvement over common cleaning products, such as chlorinated solvents. The use of n-propyl bromide is an advantageous alternative for chlorinated solvents, such as perchloroethylene. This compound is extremely effective at separating oils and greases from oil-absorbing materials, such as polypropylene. Furthermore, n-propyl bromide leaves these materials with a fresher scent and a softer feel than the chlorinated solvents. N-propyl bromide appears to be just as effective at removing stains and body oils for fabric and more effective at removing the types of oils found in industrial processes. More importantly, n-propyl bromide is not considered by federal and state agencies to be a hazardous substance. Accordingly, users of this compound do not require all of the permits typically mandated by local, state, and federal agencies. This result greatly reduces compliance costs. Although n-propyl bromide cost more to purchase per pound chlorinated solvents, these additional costs are more than recouped by the decrease in energy costs required to incorporate n-propyl bromide into the cleaning component of the present process. For example, forty percent less energy is used when n-propyl bromide is the cleaning fluid as when perchloroethylene is used. Since N-propyl bromide is not considered a hazardous waste and this eliminates costly disposal fees. Moreover, the properties of n-propyl bromide are such that a shorter drying time is required for fabrics. Accordingly, throughput of the fabrics is dramatically increased.

Another feature of the present invention is the optional component including the removal of excess extraneous substance. A considerable amount of extraneous substances can be removed from fabrics simply by allowing them to drain. Not only does excess extraneous substance drain readily from the fabrics, but also particles and metal chips can be removed in this way. By minimizing the amount of residual lubricants and particles in the fabrics in this optional component of the present process, more extraneous substance is recovered and the cleaning component is more effective in cleaning the fabrics for recycle.

The invention also encompasses a cleaning fluid that includes n-propyl bromide and a pH-balancing agent present in an amount sufficient to minimize the corrosiveness of the cleaning fluid. In a preferred embodiment, this cleaning fluid is substantially free of hazardous materials. In another preferred embodiment, the pH-balancing agent includes a base or a buffer to minimize or reduce the acidity of the other components in the cleaning fluid. In a more preferred embodiment, the pH-balancing agent can include soda ash, potassium carbonate or another potash-containing material, or any combination thereof. In another embodiment, the ratio of pH-balancing agent to n-propyl bromide is from about 1:1 to about 1:20. In yet another embodiment, the cleaning fluid further includes an odor-controlling agent present in an amount sufficient to minimize or mask an undesired odor in the textile absorber or the cleaning fluid, or both. In a preferred embodiment, the odor-controlling agent includes a sulphate. In a more preferred embodiment, the sulphate includes N-soya-N-ethyl morpholinium ethosulphate.

The invention also encompasses methods for removing extraneous substances from at least one textile absorber by cleaning each textile absorber in any of the cleaning fluids described herein to remove a portion of the extraneous substances from each textile absorber, and separating an amount of cleaning fluid and the portion of extraneous substances from each cleaned textile absorber. In a preferred embodiment, the cleaning fluid includes n-propyl bromide that is substantially free of a hazardous stabilizer component. In one embodiment, a non-hazardous stabilizer component is further included in the cleaning fluid. In one embodiment, the cleaning fluid is entirely free of any hazardous stabilizers.

In another aspect, the invention further encompasses a method for removing extraneous substances from at least one textile absorber by dry cleaning each textile absorber in reused cleaning fluid including n-propyl bromide, which is at least substantially free of any hazardous stabilizer component, to remove a first portion of extraneous substances from each textile absorber, separating a first cleaning fluid portion and the first portion of extraneous substances from each dry cleaned textile absorber, and distilling the first cleaning fluid portion to remove an amount of the first portion of extraneous substances therefrom. In this embodiment, the distilled cleaning fluid contains less than about 15% extraneous substances, preferably less than about 5%, and more preferably less than about 1% of extraneous substances.

In other embodiments, the method further includes initially physically removing excess extraneous substances from each textile absorber, either by gravity or by centrifuging, before the dry cleaning. In yet another embodiment, the method further includes two sequential distillation steps. In various embodiments, the cleaning fluid includes n-propyl bromide free of hazardous stabilizers and, optionally, including one or more of a non-hazardous stabilizer component, odor-controlling agent, and a pH-balancing agent.

In another embodiment, the method includes circulating the cleaning fluid through a closed loop cleaning system so that a portion of the cleaning fluid contacts each textile absorber for dry cleaning in a dry cleaning zone, wherein the closed loop cleaning system includes at least one component formed to include stainless steel, nickel, or copper on any surface that contacts the cleaning fluid. In a preferred embodiment, the cleaning fluid is stored at ambient temperature.

The invention also encompasses dry cleaning machines for cleaning fabrics or other textile absorbers with an n-propyl bromide type cleaning fluid that includes a housing, a rotating drum enclosed in said housing, a holding tank dimensioned to receive a quantity of dry cleaning fluid that is in fluid communication with said rotating drum, a filter system in fluid communication with said rotating drum, said filter system including a plurality of filters that are vertically arranged and that having decreasingly smaller filter pores from the highest filter to the lowest filter, a vapor filtering system in fluid communication with said rotating drum, said vapor filtering system including a fan, a vapor filter, a cooling coil, and a steam heating coil, wherein said fan, said vapor filter, said cooling coil, and said steam heating coil are interconnected, a dry cleaning fluid reclamation system that is in fluid communication with said rotating drum, said dry cleaning fluid reclamation system including a distiller having a heating element that is in fluid communication with a chilling unit, a water separator that is in fluid communication with said cooling coil, said chilling unit, and said holding tank, and a controller for automating a dry cleaning machine, said controller being operably connected to said rotating drum, said holding tank, said filter system, said vapor filtering system, said dry cleaning fluid reclamation system, and said water separator.

BRIEF DESCRIPTION OF THE DRAWINGS

Other features and advantages of the present invention will be apparent to those skilled in the art from a careful reading of the Detailed Description of the Preferred Embodiments presented below and accompanied by the drawings.

DETAILED DESCRIPTION OF THE PREFERRED EMBODIMENTS

Figure 1:
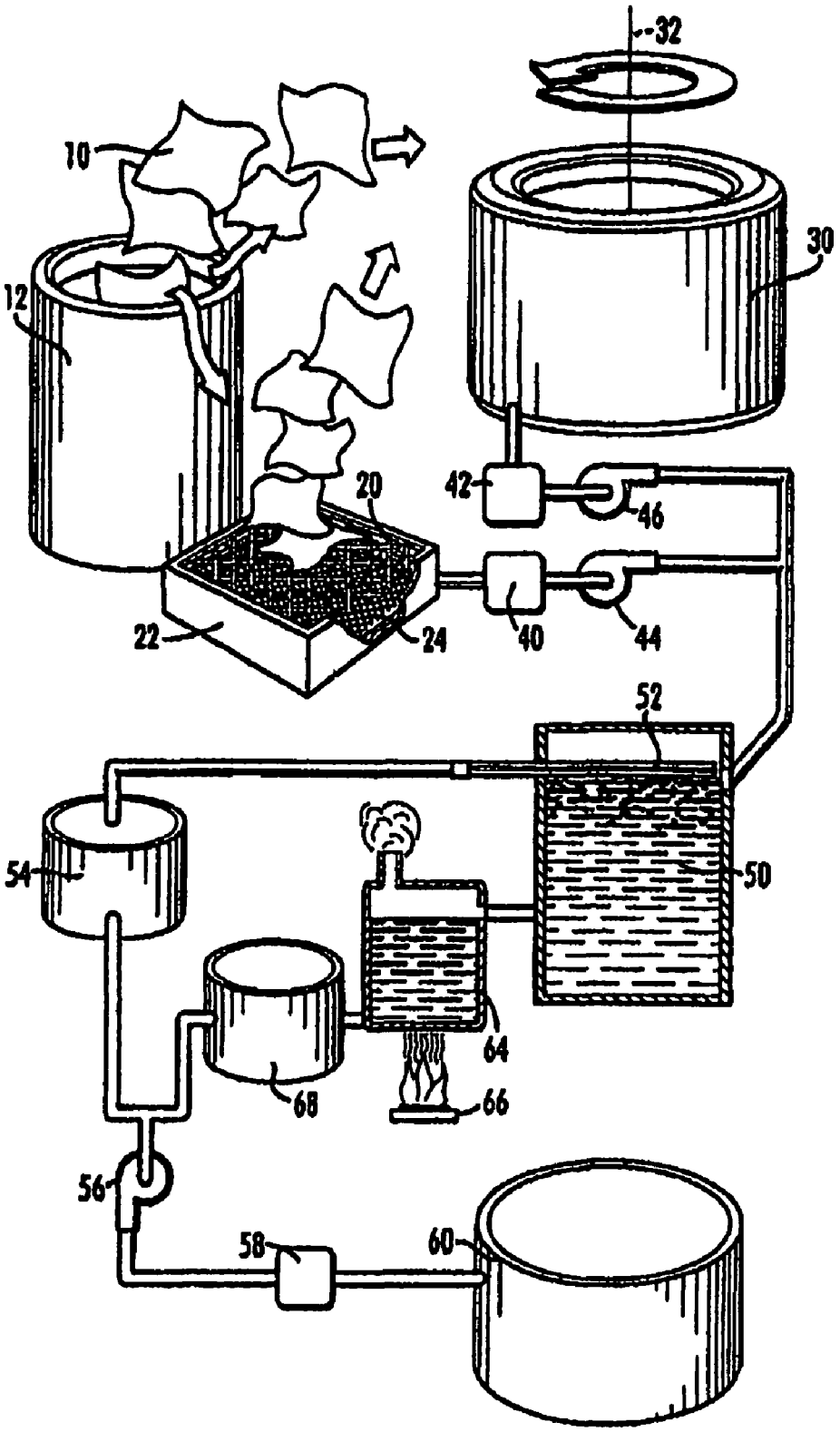
FIG. 1 is a schematic diagram of the first component of a cleaning system according to an embodiment of the present invention.
Figure 2:
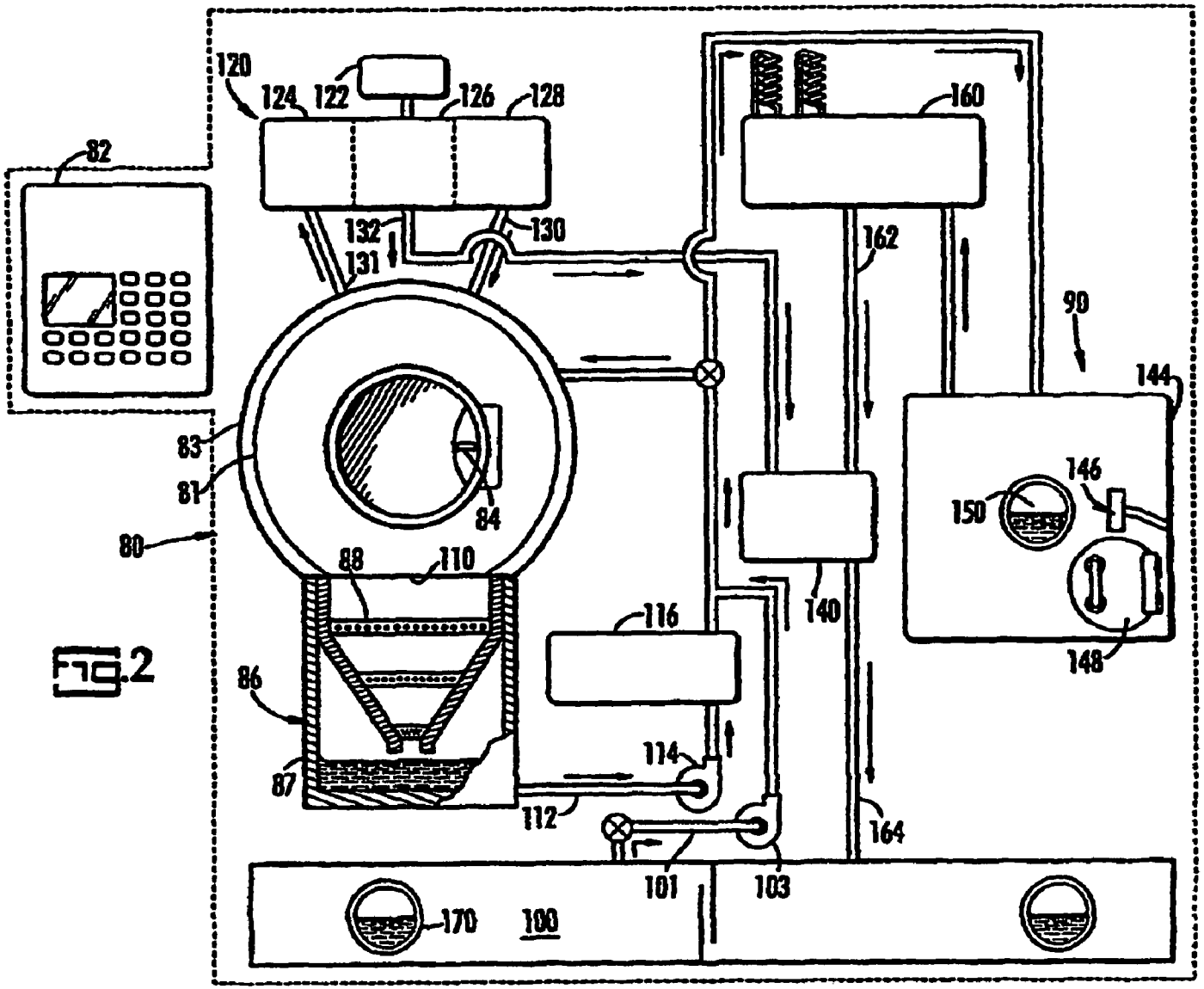
FIG. 2 is a schematic diagram of the second component of a cleaning system according to an embodiment of the present invention.
Figure 3:
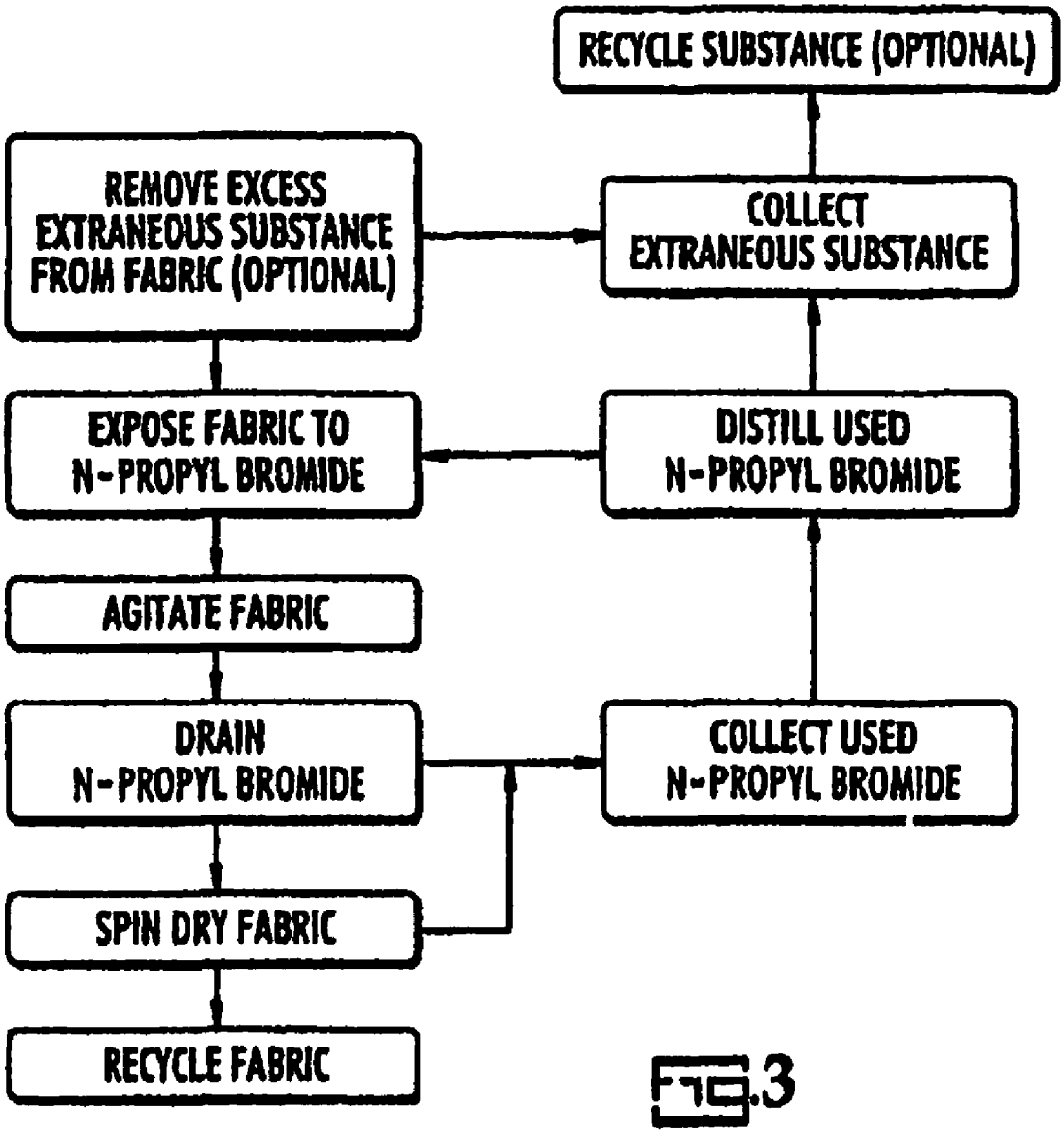
FIG. 3 is a flow chart of a process according to an embodiment of the present method.

Referring now to FIGS. 1-3 there are illustrated schematic diagrams and a flow chart of a method and apparatus for separating extraneous substances from fabrics according to the present invention. It is contemplated by the present invention that any type of fabric, be it woven, non-woven, natural, or synthetic, can be cleaned using the following method and apparatus. Furthermore, it is also contemplated that any type of extraneous substance that typically attaches to or becomes absorbed by fabrics can be removed or desorbed by the following method and apparatus.

A goal of the present invention is cleaning and recycling; in particular, the present system cleans fabrics for reuse and allows for recovery and recycling of extraneous substances depending on what these substances are. The more effective the present system is, the more extraneous substance it recovers, i.e. for recycling, and the cleaner the system gets the fabrics. Furthermore, no hazardous waste is generated from the practice of the present invention. As discussed, the main component of the present invention is the cleaning component. However, an optional component to the present process is a removal component in which excess extraneous substance is removed from the fabrics. This optional component is directed to the separation of and recovery of extraneous substances from the fabrics. In the cleaning component, the fabrics are cleaned using means and method for cleaning the fabrics so that these fabrics can be reused and the maximum amount of cleaning fluid can be recovered and also reused. Waste products can be significantly reduced, if not altogether eliminated, by using a particular kind of dry cleaning fluid.

The removal of excess extraneous substance is an optional component of the present invention, and is not necessary to the practice of the invention. If the present system is employed to clean clothes, this optional step is not required. However, this component may be helpful in the case that industrial-type fabrics are being cleaned. The desorption of extraneous substances, such as oil and other industrial lubricants, from absorbent-type fabrics, is a prevalent industrial process. Absorbent fabrics used in industrial settings include synthetic and natural, woven and non-woven fabrics, which may come in the form of pads, sheets, shop cloths, and tubular "socks," and which are customarily used in machine shops and metal fabricating plants to absorb spilled or leaking lubricants. Additionally, the industrial uniforms used in these plants become soiled with similar extraneous substances. For convenience, these fabrics will be referred to herein as textile absorbers. As used herein, "textile absorbers" refer to fabrics and other manufactured products made from natural or manufactured fibers and filaments, as well as yarns, which have the ability to take up another material. Common textile absorbers include polypropylene, polyester, and cotton.

Accordingly, by way of example, FIG. 1 illustrates this optional removal step. As shown, textile absorbers 10 are sometimes collected in barrels 12 for a period of time prior to beginning the present process. While standing in barrels 12, extraneous substances, such as oil, lubricants, and solvents will drain down through a stack of textile absorbers 10, pooling in the bottom of barrels 12. Textile absorbers 10 at the top of the stack will be relatively free of excess extraneous substance; those at the bottom will contain excess extraneous substance, perhaps being soaked in it. The longer the barrels 12 stand undisturbed, the more extraneous substance will drain to the bottom.

Textile absorbers 10 that are located near the top of the barrels 12 can go directly into the cleaning component of the present process. Textile absorbers 10 located near the bottom of the barrels 12 can be placed on an elevated coarse grid 20 over a collection basin 22 to drain additional extraneous substance from them. The longer the textile absorbers 10 are allowed to drain, the less extraneous substance will have to be removed from the textile absorbers 10 in the cleaning component of the present invention. Barrels 12 of containers holding absorbers 10 can include could plugs that can be removed to let the extraneous substances drain out. Alternatively, textile absorbers 10 located near the bottom of the barrels 12 can be manually wrung or squeezed mechanically so as to remove excess extraneous substance before the textile absorbers 10 enter the cleaning component of the present process.

Although the use of the elevated grid 20 and collection basin 22 is an optional feature of the present invention, if used, preferably a fine mesh grid 24 is located below the elevated coarse grid 20. Extraneous substance drains through the coarse and fine mesh grids 20, 24, to the lower portion of the basin 22. Particles, dirt, metal chips, and cuttings collect on fine mesh grid 24 and can be removed in a variety of ways, such as vacuuming. If the textile absorbers 10 have been stored in barrels 12, extraneous substance pooled in the bottom of the barrels 12 can be poured directly into collection basin 22.

In order to further remove excess extraneous substances from the textile absorbers 10 before entering the cleaning component of the present invention, the textile absorbers 10 can be centrifuged at a high speed in a centrifuge 30 with a vertical axis 32 of rotation. Preferably, the centrifuge 30 operates at about 900 to 1200 revolutions per minute (RPM) in approximately seven minutes the excess extraneous substances are removed. The textile absorbers 10 have less than about 2% and preferably less than about 0.5% extraneous substances remaining.

From collection basin 22 and from centrifuge 30, the extraneous substances, such as oil, can then be directly shipped to a processing facility, such as a refinery. Alternatively, the extraneous substances can first be transferred to a recovery system. For example, if the extraneous substance is made up mostly of oil, the oil can be pumped through filters 40, 42, using pumps 44, 46, respectively, to a settling tank 50. Filters 40, 42, remove additional particulate although some will collect on the fine mesh grid 24 of collection basin 22 and more will settle to the bottom of the basin 22.

In the settling tank 50, the extraneous substances are allowed to stand so that fine particulate settles to the bottom as sludge while the fluid substances rise to the top. Water that has mixed with the extraneous substances tends to separate below these substances but above the heavier sludge. Settling tank 50 is equipped with a pipe 52, located within the upper region of the tank 50 and in fluid communication with its interior. When the oil reaches a certain level, it enters pipe 52 and flows, by gravity, to a first barrel 54. Periodically, the extraneous substances collected are pumped using pump 56 through a bag filter 58 to storage tank 60. Preferably, filter 58 is sized to capture solids having a particle size greater than or equal to approximately 200 microns.

Extraneous substances from lower elevations of settling tank 50 drain to an evaporator 64. Heat from a heat source 66 is applied to evaporator 64 to remove water from these extraneous substances. Then the extraneous substances are skimmed from evaporator 64 and drained to a second barrel 68. Periodically, extraneous substances that are collected are pumped by pump 56 to holding tank 60 via bag filter 58.

The extraneous substances recovered from the textile absorbers 10 and separated from both particulate by bag filter 58 and from water by evaporator 64 can thereafter be shipped to a refinery for further processing. Thereafter, the partially cleaned textile absorbers 10 can be introduced into the cleaning component of the present process for the removal of any remaining extraneous substances.

In the cleaning component of the present process, clothing fabrics and textile absorbers alike can be cleaned through the use of n-propyl bromide. As discussed, the textile absorbers 10 are optionally subjected to the removal of excess extraneous substances by gravity draining, by gravity draining in combination with centrifuging, by wringing, or squeezing, prior to being cleaned using n-propyl bromide as the cleaning fluid. Alternatively, the clothing fabrics and textile absorbers 10 can be solely treated by the cleaning component. A commercially available form of n-propyl bromide exists under the name TECHTRIDE®, which is sold for use in vapor degreasing. However, this form of n-propyl bromide contains various hazardous materials, such as hazardous stabilizers that manifest in the form of hazardous still bottoms, hazardous air pollutants, or other hazardous residuals during the cleaning process, and which require removal, disposal, and/or other specialized treatment or licensing to even operate the equipment or the facility in which the equipment is operated. Hazardous stabilizers that are commonly used to stabilize n-propyl bromide include one or more chemicals selected from the general groups of ethers; phenols; nitroalkanes; epoxides; benzotriazoles; alcohols; ketones; acetals; amines; saturated hydrocarbons; alkenes; alkynes; and esters. More specifically, hazardous stabilizers that are known to be used with various conventional commercial n-propyl bromide formulations to stabilize n-propyl bromide include one or more of 1,3-dioxolane; 1,2-epoxybutane; 1,2-butylene oxide; nitromethane; t-butanol; tert-butyl alcohol; trimethoxymethane; and methylal, which although advantageous in degreasing processes, are not necessary or helpful for the present process and are preferably intentionally excluded from the cleaning fluid. Some of these "hazardous materials" are hazardous only in sufficient amounts, however, in sufficiently small quantities these are not necessary hazardous and can be included in the invention.

Preferably, the cleaning fluid is substantially pure n-propyl bromide or consists essentially of n-propyl bromide. As used herein, "substantially pure" refers to a cleaning fluid that can contain about 100% of that cleaning fluid or that can also include other substances. Thus, in one embodiment, the cleaning fluid is substantially free, and preferably entirely free, of hazardous materials, such as the hazardous stabilizers described above.

As used herein, "substantially free" is typically understood to be less than about 3 weight percent, preferably less than about 2 weight percent, and more preferably less than about 1 weight percent, of the undesired component. In a preferred embodiment, the term "substantially free" refers to less than about 0.5 weight percent, preferably less than about 0.15 weight percent, and more preferably less than about 0.05 or 0.01 weight percent. As used herein, "completely free," "entirely free," or "free" is understood to mean an absence of, i.e., less than an analytically detectable amount, of the hazardous component(s).

The cleaning fluid may optionally include certain stabilizers in the case that the particular cleaning method and apparatus dictates it, but such stabilizers are preferably non-hazardous and include either stabilizers not discussed herein as being hazardous or that type of stabilizer but in an amount insufficient to pose an environmental hazard. In a preferred embodiment, the cleaning fluid consists essentially of n-propyl bromide and a non-hazardous stabilizer component of one or more non-hazardous stabilizers. In another preferred embodiment, the cleaning fluid is substantially free of hazardous stabilizers whether or not a non-hazardous stabilizer component is included.

In the application of fabrics not contaminated with oils, the addition of one or more detergents or soaps is recommended to suspend particles so that they do not deposit back on the fabric. Also, the addition of sizing or softening agents to give the fabric a softer and better feel can be employed. Perfuming agents or deodorizers could also be employed to improve the stain removal and odor of the fabrics. The cleaning fluid can have an undesirable odor, due in part to oils and other extraneous substances that are removed from the textile absorbers, and also due to in part to the n-propyl bromide itself. To address any undesirable odors, an odor-controlling agent is added to the cleaning fluid, preferably in an amount and of a type as needed to the cleaning fluid while disposed in the holding tanks. Thus, the cleaning fluid can optionally, but preferably, also include an odor-controlling agent that includes a perfuming agent, deodorizer, or any combination thereof. The odor-controlling agent is preferably present in an amount sufficient to minimize or avoid, or to mask, undesirable odors. The odor-controlling agent preferably includes one or more sulfates. In a preferred embodiment, the odor-controlling agent is N-soya-N-ethyl morpholinium ethosulphate, which is commercially available under the trade name FORESTALL®. Any other suitable odor-controlling agent can be included alone or in combination with N-soya-N-ethyl morpholinium ethosulphate. Preferably, small amounts of odor-controlling agent in ratios of about 1:5 to 1:50, more preferably about 1:8: to 1:20, of odor-controlling agent to n-propyl bromide by weight. An exemplary ratio of odor-controlling agent to n-PB is about 1:12. In another embodiment, about 0.5 ounces to 8 ounces of an odor-controlling agent can be added at a time to the cleaning fluid. Including too high an amount of odor-controlling agent may tend to decrease the cleaning power of the cleaning fluid, so those of ordinary skill in the art will select suitable amounts to provide odor-control without significantly reducing cleaning ability.

Various cleaning methods and apparatuses can be employed in this cleaning component, and no particular cleaning technique is critical to the present invention. However, by way of example, a preferred cleaning technique is dry cleaning. In the case that dry cleaning is employed, a preferred apparatus for dry cleaning is shown in FIG. 2. As illustrated, fabrics containing extraneous substances can be cleaned in an industrial dry cleaning machine 80 that has been modified for the present purposes. The dry cleaning machine 80 can be controlled by a computer controller 82, operating various components of the dry cleaning machine 80, including temperature, pressure, the opening and closing of valves, and the activation of pumps, so that the operation can take place efficiently.

In particular, the dry cleaning machine 80 can include a rotating drum 81 supported in a housing 83 and that can be accessed by a door 84. The drum 81 is capable of containing the various textiles that need to be washed. A source of dry cleaning fluid can be contained by a holding tank 100 that is in fluid communication with the drum 81 through line 101. Dry cleaning fluid can be introduced into drum 81 by holding tank 100 through the use of pump 103. Holding tank 100 can further include 170 for viewing the quality and quantity of the dry cleaning fluid.

Below the drum 81 can be included a filter system 86 having a plurality of filters 88. As shown, the filters 88 are arranged vertically, and can include increasingly smaller pores 89 from the highest filter to the lower most filter so as to more effective filter suspended solids within the used dry cleaning fluid. The filter system 86 can further include a filter container 87 for housing the filter system 86 and for containing the filtered and used dry cleaning fluid. Between the drum 81 and the filter system 86 can be included a partition 110, which can be opened and closed periodically depending on what stage in the dry cleaning process requires the draining and filtering of dry cleaning fluid. As further shown, the filter container 87 is in fluid communication with line 112 and pump 114. Through the use of line 112, dry cleaning solvent can either be returned to drum 81 or sent to a dry cleaning fluid reclamation system, which will be discussed further below. Additionally, a lint and dye removal filter 116 can be included along line 112 for the purpose of further purifying the dry cleaning fluid during the dry cleaning process.

The rotating drum 81 can also be in fluid communication with a vapor filtering system 120. This system 120 can include a fan 122, a vapor filter 124, a cooling coil 126, and a steam heating coil 128. These features can be interconnected with the drum 81 through lines 130 and 131. Further, the cooling coil 126 can be used to separate and condense the dry cleaning fluid from any other gas, such as steam, that is being circulated in the vapor filtering system 120. Accordingly, the cooling coil 126 can also be connected to a water separator 140 through line 132. Although a number of different materials can be used for the cooling coil 126 and the steam coil 128, the coils can include nickel, nickel-plated, or stainless steel coils, as well as other metals not susceptible to chemical degradation resulting from the cleaning process.

The dry cleaning machine 80 can also include a dry cleaning fluid reclamation system 90 for purifying used dry cleaning fluid for reuse. As shown, the reclamation system 90 can include a single distiller 144 that can include a temperature controlled heating element 146. The distiller 144 can also include an access door 148 that is employed when the distillers 144 is in need of repair or cleaning. Further, the distiller 144 can include a window 150 so that operators are aware of when repair and cleaning is necessary. The distiller 144 can be in fluid communication with a chilling unit 160 wherein the distilled dry cleaning fluid is condensed. Because other fluids, such as water, may be condensed along with the dry cleaning fluid, the chilling unit 160 can also be in fluid communication with the water separator 140 through line 162. The condensed and separated dry cleaning fluid can be returned to the holding tank 100 from the water separator 140 through line 164.

In the first stage of the cleaning component, fabrics including extraneous substances are placed inside the drum 81 to undergo the washing cycle. Optionally, a pillow designed to retain an amount of conditioning agents resulting in softer and better smelling fabrics can be added along with the fabrics needing to be washed. Depending on the weight of the fabrics needing to be cleaned, an amount of dry cleaning fluid is pumped into the drum 81 through line 101. This dry cleaning fluid can include pure n-propyl bromide, as well as reclaimed or distilled n-propyl bromide. Although various amounts of cleaning fluid can be used, for about 10 pounds of dry fabric needing to be cleaned, about 10 to about 15 gallons of dry cleaning fluid can be used during the washing cycle. Accordingly, about a 1:1 to about 1:1.5 ratio of pounds of dry fabric to gallons of dry cleaning fluid can be employed for the washing cycle. Once the dry cleaning fluid has been pumped from the holding tank 100 into the drum 81, line 101 is closed and remains closed for the duration of the cleaning process. Various sized holding tanks 100 can be employed. However, for industrial purposes, the use of a holding tank 100 that can contain from about 160 gallons to about 240 gallons of dry cleaning fluid is helpful.

Where the cleaning fluid is substantially pure n-propyl bromide or consists essentially of n-propyl bromide, it is preferable that the pH of the cleaning fluid is maintained in equilibrium with minimal fluctuation. The pH can be regularly monitored as frequently as needed to help maintain the pH. For example, the pH of the cleaning fluid can be monitored at least once a week, more preferably at least every other day, and even more preferably at least daily in unstable situations, as can be readily determined by those of ordinary skill in the art with the present discussion as guidance. Such monitoring may be warranted because the cleaning fluid can have a tendency to become acidic. This may be especially common, for example, when water from the water separator 140 is also acidic relative to the cleaning fluid. As a result of this increased acidity, the cleaning fluid may become acidic and less stable, which tends to result in increased corrosiveness of the n-propyl bromide and cleaning fluid that can damage and corrode valves, piping, seals, and other parts in the dry cleaning equipment, particularly certain types of metal and plastic parts.

To minimize or prevent pH fluctuations in the cleaning fluid, particularly an increase in acidity, a pH-stabilizing agent is optionally but preferably added to the cleaning fluid. The pH-stabilizing agent is typically a base or a buffer, preferably a base. Any suitable base or buffer may be used to increase the pH (i.e., decrease the acidity) of the cleaning fluid. In a preferred embodiment the pH-stabilizing agent is preferably sodium carbonate ($Na_2CO_3$) (also known as "soda ash"), potassium carbonate ($K_2CO_3$) or other potash-containing material, or a combination thereof. The pH-stabilizing agent is preferably provided in any suitable form that will readily permit combination with the remainder of the cleaning fluid, for example, in liquid form. Where the pH-stabilizing agent is a solid, it can be combined to the cleaning fluid as a liquid by use of a liquid carrier, such as in solution, suspension, or emulsion form. The pH-stabilizing agent can also be provided in a readily dispersible solid form directly to the cleaning fluid, for example, as microspheres, granules, pellets, or other particulate forms to facilitate dispersion.

The basic properties of the base or buffer, e.g., potash or soda ash, act to help neutralize acid and inhibit or prevent further acid formation in the cleaning fluid to minimize or prevent corrosive effects on certain metal or plastic components of the dry cleaning equipment. Preferably, the pH-stabilizing agent is added as needed to minimize or prevent degradation or corrosion of non-resistant metal and rubber parts in the cleaning equipment. Typically, the pH-stabilizing agent is added in an amount sufficient to minimize or prevent an increase in acidity, e.g., to prevent a decrease in pH of about 0.5 or more. Preferably, the ratio of pH-stabilizing agent to n-propyl bromide is from about 1:1 to about 1:20, and more preferably in a ratio of about 1:2 to 1:10. In a more preferred embodiment, the ratio is about 1:5. Including too high an amount of pH-stabilizing agent may tend to decrease the cleaning power of the cleaning fluid, so those of ordinary skill in the art may tend to select suitable amounts of pH-stabilizing agent to modify the pH sufficiently to minimize or prevent corrosion or degradation problems with the cleaning equipment without including amounts so substantial as to significantly reducing cleaning ability. In any embodiment where the cleaning agent itself has a relatively high pH (i.e. is more basic), the pH-stabilizing agent that is added to the cleaning fluid may be an acid or a buffer.

The pH-stabilizing agent can be added when necessary. For example, periodic testing of the cleaning fluid pH can be conducted after or even during cleaning cycles, or a periodic dose can be provided. For example, pH testing and or application of an additional sufficient amount of pH-stabilizing agent can be added daily, or after every one to eight cleaning cycles (e.g., loads of textile absorbers). The timing and dose can be readily determined by those of ordinary skill in the art.

During the washing cycle, which can preferably last from about 8 to about 10 minutes, the fabrics become tumbled and washed. Simultaneously, the partition 110 between the drum 81 and the filtering system 86 can be opened, so that the dry cleaning fluid is filtered by the filtering system 86 during the wash cycle and then pumped back into the drum 81 through line 112. At the end of the wash cycle, the partition 110 is closed and the drying cycle begins whereby the fabrics are rotated at varying speeds to remove any excess dry cleaning fluid. For example, the rotating drum 81 can be rotated successively at about 100 rotations per minute (RPM), at about 250 to about 300 RMP, and at about 500 to about 550 RPM, for about 5 to about 10 minutes so that the fabrics become completely dry. To facilitate the drying of the fabrics, the vapor filtering system 120 can be employed during the drying cycle. Upon engagement of the fan 122, air starts circulating along a closed circuit, passing successively through the drum 81, the vapor filter 124, the cooling coil 126, and the steam heating coil 128. The steam heating coil 128 can heat the air circulating through the loop to a temperature sufficient to evaporate and remove any remaining dry cleaning fluid from the fabrics. This temperature can vary depending on the amount of fabrics being cleaned, and on whether the closed system is operated under any pressure. However, the temperature can range from about 700° F. to about 160° F. in a typical drying cycle. The dry cleaning fluid extracted from the fabrics during this stage is condensed from the circulating air in the cooling coil 126 and passes through line 132 to the water separator 140.

Simultaneously with the drying cycle, or after the drying cycle, the used dry cleaning fluid that is collected in the filter container 87 is pumped to the distiller 144 so that the fluid can be reclaimed for reuse in other washing cycles. Once in the distiller 144, the used dry cleaning fluid is heated by the heating element 146. Again, the temperature within the distiller 146 can vary based on differences in purity of solvent and in pressure of the system. However, if the distiller 144 is operated under about 3 to about 4 pounds, of pressure, the distilling temperature can be from about 70° F. to about 160° F. The resulting dry cleaning fluid vapors then pass to the chilling unit 160 where the vapors are condensed and drain into the water separator 140. Because the dry cleaning fluid vapors and condensation may include water, including a water separator 140 is beneficial to obtaining a higher percentage of purified dry cleaning fluid. Once separated within the water separator 140, the reclaimed dry cleaning fluid drains into the holding tank 100 for further use. The distilled dry cleaning fluid preferably contains less than approximately 15% extraneous substances. Most preferably, the distilled dry cleaning fluid contains less than approximately 5% extraneous substances.

Depending on the types of fabrics being cleaning, variations can be made in the apparatus for preferred conditions. For example, when dry cleaning the textile absorbers 10 using n-propyl bromide, the distiller 146 must be able to achieve a temperature between about 70° F. and about 150° F. to affect the phase separation. The distillation point of n-propyl bromide varies depending on the amount the particular extraneous substance with which it is combined. It is understood that the temperature at which separation occurs will vary as a function of both the dry cleaning fluid used and the type of lubricant removed, and therefore an artisan with ordinary skill would alter the temperature of the distiller accordingly.

As discussed, the use of n-propyl bromide is a particular feature of the present invention. This cleaning fluid is an environmentally sound and advantageous alternative to commonly used chlorinated solvents, such as perchloroethylene. N-propyl bromide is extremely effective at separating oils and greases from oil-absorbing materials, such as polypropylene. Furthermore, n-propyl bromide leaves these materials with a fresher scent and softer feel than the chlorinated solvents. N-propyl bromide appears to be just as effective at removing common stains or stains on the fabric from body oils and more effective removing the types of oils found in industrial processes. More importantly, n-propyl bromide is not considered by federal and state agencies to be a hazardous substance and should be safer to operate by employees. Accordingly, users of this compound do not need permits from federal and state agencies. This result greatly reduces compliance costs and permitting fees. Further, the used filters and still bottoms from the present invention are not considered to be hazardous waste, and can be more easily disposed.

Although n-propyl bromide costs more to purchase by the pound than a majority, if not all, of chlorinated solvents, and can cost as much as three times that of chlorinated solvents, these additional costs are more than recouped by the decrease in energy costs required to incorporated n-propyl bromide into the cleaning component of the present process. On average, forty percent less energy is used when n-propyl bromide is the cleaning fluid as when perchloroethylene is used. Additionally, the use of n-propyl bromide eliminates hazardous waste disposal costs. Moreover, the properties of n-propyl bromide are such that a shortened drying time is required for the oil-absorbing materials. For example, the distillation point of n-propyl bromide when used in the dry cleaning process is between about 70° F. and about 160° F., whereas the distillation point of perchloroethylene is approximately 265° F. Accordingly, the time needed to recycle the textile absorbers 10 and other fabrics is dramatically reduced and throughput of the textile absorbers 10 and other fabrics increased. Not only does the low distillation point of n-propyl bromide save on energy costs, but also it obviates the need for the use of industrial powered distillers. This lower distillation point also results in a safer working environment considering the process removes the need to operate equipment at extremely high temperatures or pressures. All of these advantages are even more beneficial where the cleaning fluid is substantially pure n-propyl bromide or consists essentially n-propyl bromide substantially free of hazardous stabilizers.

The equipment can be adapted to include a pressure adjustment device, which can be for example a dial, button(s), or electronic adjustment device to permit modification of the pressure in the cleaning device. For example, each step up or down in pressure could result in about 10 to 25 percent change in pressure. It is also possible to arrange for each increment of pressure to adjust the pressure by about 1/10 to 1/4 pound. Too much pressure, or too quickly a change in pressure, can undesirably cause foaming or boiling of the cleaning fluid. Without being bound by theory, it is believed that the pressure depends in part on one or more of the amount of solvent being used, the amount of textile absorbers being cleaned, and the amount of extraneous materials present therein. Therefore, the pressure adjustment device can be adapted to limit the rate of change in pressure within the distilling portion of the apparatus. Preferably, the pressure adjustment device includes a display to illustrate the pressure, and more preferably also the temperature, in the cleaning device particularly during operation to facilitate adjustment of the pressure.

Another advantage of n-propyl bromide over perchloroethylene is that n-propyl bromide is much less dense than perchloroethylene. Preferably, the cleaning fluid of the present invention is substantially free, more preferably entirely free of perchloroethylene. N-propyl bromide weighs about 11 pounds per gallon, whereas perchloroethylene weighs about 13.5 pounds per gallon, which is roughly 20% greater. Accordingly, there is less stress on the dry cleaning machine when the same amount of n-propyl bromide is used as when perchloroethylene is used. However, because n-propyl bromide is closer to the density of water, the separation of n-propyl bromide from water becomes more difficult. A variety of water separators can be employed. For example, the present invention can include a water separator having a settling reservoir that is in fluid communication with internal collection pipes that are oriented so as to divert the water layer that will form, typically the top layer, from the cleaning fluid layer that will form, or the bottom layer. However, these pipes must be spaced farther apart than pipes used in perchloroethylene dry cleaning machine. Further, sudden changes in temperature can cause the n-propyl bromide to fizz and bubble. Therefore, the water separator should be larger than typical water separators found in standard dry cleaning machines.

Still another advantageous property of n-propyl bromide is that it evaporates at a lower temperature than perchloroethylene. This is particularly the situation where the cleaning fluid is substantially pure n-propyl bromide or consists essentially of n-propyl bromide substantially free of hazardous stabilizers. Consequently, fabrics require a shorter drying time, between about 5 minutes to about 10 minutes, as opposed to 30 minutes to 60 minutes with perchloroethylene. However, because of the chemical properties of n-propyl bromide, certain precautions can be taken to improve the durability of the dry cleaning machine 80. For example, the sealants on the access doors described can be treated with a surfactant that repels the n-propyl bromide and prevents it from dissolving the sealant material. Alternatively, the door sealants can be made of plastic, which is resistant to the n-propyl bromide. Additionally, the piping, coils, tanks, and any other parts of the cleaning equipment can preferably be made of stainless steel, copper, or nickel, which are less susceptible to corrosion by n-propyl bromide. Stainless steel is preferred. Other n-PB resistant materials may be used in place of these if desired.

Holding tank 100 can be modified from that of conventional dry cleaning machines. The tank of conventional machines has partitions to define compartments for separating the n-propyl bromide into batches. In the present tank 100, the partitions can be removed or modified so that the compartments communicate with each other and, if needed, the tank 100 is enlarged so that more n-propyl bromide is available for each load of fabrics.

Other modifications include replacement of pumps with larger capacity pumps and replacement of smaller electrical solenoid addition valves with pneumatic stainless steel ball valves. In to these changes, the dry cleaner's internal lint filter is also removed. An example of an industrial dry cleaner capable of use with the present invention is the Columbia, ILSA 80 lb. Dry Cleaning Machine manufactured in Italy (US HQ, New York) or the Union U-2000 L Series in the 80 pound capacity size manufactured by Union Drycleaning Products of East Point, Ga.

At the end of the dry cleaning process, cleaned fabrics and textile absorbers 10 are folded and packaged in clean plastic bags for return to the owner. Extraneous substances collected by either the filters or the distiller 144 can thereafter be forwarded for further processing and possible reuse if appropriate for the type of extraneous substance. Preferably, the cleaning equipment can be adapted and configured so that a single distiller or pair of distillers (not shown) can be operatively associated with a plurality of dry cleaning circuits, e.g., one distiller device linked through piping to multiple rotary drums, holding tanks, or the like. Waste from various sources, such as extracted from the distilling apparatus and the extraneous materials removed from the textile absorbers can be sent to treatment facilities for processing and disposal or recycling.

The term "consisting essentially of," as used herein in some embodiments, is intended to minimize or exclude hazardous air pollutants (HAPs) or other hazardous stabilizers that are found in conventional commercial forms of n-propyl bromide such as TECHTRIDE®. Although the term "dry cleaning" typically refers to cleaning in the absence of water, as used herein it is intended to mean that the cleaning fluid is substantially free of added water (i.e., that not present in any components in the cleaning fluid, e.g., as a pH-stabilizing agent), preferably free of water.

The term "about," as used herein, should generally be understood to refer to both numbers in a range of numerals. Moreover, all numerical ranges herein should be understood to include each whole integer within the range. Further, unless otherwise noted, where applicable all quantity percentage amounts are weight percent as opposed to volume percent.

While illustrative embodiments of the invention are disclosed herein, it will be appreciated that numerous modifications and other embodiments may be devised by those of ordinary skill in the art. Therefore, it will be understood that the appended claims are intended to cover all such modifications and embodiments that come within the spirit and scope of the present invention.

What is claimed is:

1. A method for removing one or more extraneous substances from at least one textile absorber, comprising:

cleaning each textile absorber in a cleaning fluid which comprises: n-propyl bromide at least substantially free of a hazardous stabilizer material; and an odor-controlling agent comprising a sulphate, with the cleaning fluid present in an amount sufficient to remove a portion of the one or more extraneous substances from each textile absorber and with the odor-controlling agent present in an amount sufficient to minimize or mask an undesired odor in the textile absorber or the cleaning fluid, or both; and separating an amount of cleaning fluid and the portion of the one or more extraneous substances from each cleaned textile absorber.

2. A method for removing one or more extraneous substances from at least one textile absorber, comprising:

cleaning each textile absorber in a cleaning fluid which comprises n-propyl bromide having less than about 1 weight percent of a hazardous stabilizer material and a pH-balancing agent in an amount sufficient to minimize or prevent fluctuation of the pH of the cleaning fluid, with the cleaning fluid present in an amount sufficient to remove a portion of one or more extraneous substances from each textile absorber; and separating an amount of cleaning fluid and the portion of the one or more extraneous substances from each cleaned textile absorber, wherein an extraneous substance comprises oil.

3. The method of claim 2 wherein the cleaning comprises dry cleaning each textile absorber in reused cleaning fluid consisting essentially of n-propyl bromide and the pH-balancing agent; and further comprising distilling the first cleaning fluid portion to remove an amount of the first portion of the one or more extraneous substances therefrom, wherein an extraneous substance comprises oil.

4. The method of claim 2, wherein the cleaning fluid consists essentially of n-propyl bromide and the pH-balancing agent.

5. The method of claim 1, wherein the odor-controlling agent comprises N-soya-N-ethyl morpholinium ethosulphate.

6. A method for removing one or more extraneous substances from at least one textile absorber, comprising:

cleaning each textile absorber in a cleaning fluid which comprises n-propyl bromide having less than about 1 weight percent of a hazardous stabilizer material, with the cleaning fluid present in an amount sufficient to remove a portion of one or more extraneous substances from each textile absorber;

circulating the cleaning fluid through a closed loop cleaning system so that a portion of the cleaning fluid contacts each textile absorber for dry cleaning in a dry cleaning zone, wherein the closed loop cleaning system includes at least one component in contact with the cleaning fluid that comprises stainless steel, nickel, or copper; and separating an amount of cleaning fluid and the portion of the one or more extraneous substances from each cleaned textile absorber, wherein an extraneous substance comprises oil.

7. The method of claim 6 wherein each component of the closed loop cleaning system that contacts cleaning fluid comprises stainless steel, nickel, nickel-plated material, or copper.

8. The method of claim 2, wherein the cleaning fluid further comprises a non-hazardous stabilizer component.

9. The method of claim 2, wherein the cleaning fluid is entirely free of any hazardous stabilizer.

10. The method of claim 2, wherein the hazardous stabilizer includes one or more of 1,3-dioxolane; 1,2-epoxybutane; 1,2-butylene oxide; nitromethane; t-butanol; tert-butyl alcohol; trimethoxymethane; and methylal.

11. The method of claim 10, wherein the hazardous stabilizer includes one or more ethers; phenols; nitroalkanes; epoxides; benzotriazoles; alcohols; ketones; acetals; amines; saturated hydrocarbons; alkenes; alkynes; esters; and any combination thereof.

12. The method of claim 3, wherein the distilled cleaning fluid contains less than approximately 15% extraneous substances.

13. The method of claim 3, further comprising initially physically removing excess extraneous substances from each textile absorber by gravity or centrifuging before the dry cleaning.

14. The method of claim 3, which further comprises two sequential distillations.

15. The method of claim 2, wherein the cleaning fluid consists of n-propyl bromide, the pH-balancing agent and, one or more of a non-hazardous stabilizer component and an odor-controlling agent.

16. The method of claim 2, which further comprises circulating the cleaning fluid through a closed loop cleaning system so that a portion of the cleaning fluid contacts each textile absorber for dry cleaning in a dry cleaning zone, wherein the closed loop cleaning system includes at least one component in contact with the cleaning fluid that comprises stainless steel, nickel, or copper or is nickel- or copper-plated.

17. The method of claim 2, which further comprises storing the cleaning fluid at ambient temperature before cleaning.

18. The method of claim 2, wherein the pH-balancing agent comprises soda ash, potash, or a combination thereof.

19. The method of claim 2, wherein the ratio of pH-balancing agent to n-propyl bromide is from about 1:1 to about 1:20.

20. The method of claim 2, wherein the cleaning fluid further comprises an odor-controlling agent present in an amount sufficient to minimize or mask an undesired odor in the textile absorber or the cleaning fluid, or both.

* * * * *